US008614649B2

(12) United States Patent
Sakuma

(10) Patent No.: US 8,614,649 B2
(45) Date of Patent: Dec. 24, 2013

(54) ANTENNA AND COMMUNICATION DEVICE INCLUDING THE SAME

(75) Inventor: Masao Sakuma, Yokohama (JP)

(73) Assignee: Fujitsu Semiconductor Limited, Yokohama (JP)

( * ) Notice: Subject to any disclaimer, the term of this patent is extended or adjusted under 35 U.S.C. 154(b) by 235 days.

(21) Appl. No.: 12/842,291

(22) Filed: Jul. 23, 2010

(65) Prior Publication Data

US 2011/0025570 A1 Feb. 3, 2011

(30) Foreign Application Priority Data

Jul. 29, 2009 (JP) ..... 2009-176649

(51) Int. Cl.
*H01Q 9/28* (2006.01)

(52) U.S. Cl.
USPC ..... 343/795

(58) Field of Classification Search
USPC ..... 343/700 MS, 702, 846, 795
See application file for complete search history.

(56) References Cited

U.S. PATENT DOCUMENTS

| | | | | |
|---|---|---|---|---|
| 6,392,599 | B1 | 5/2002 | Ganeshmoorthy et al. | |
| 7,095,371 | B2 * | 8/2006 | Monebhurrun et al. | 343/700 MS |
| 7,248,227 | B2 * | 7/2007 | Chen | 343/795 |
| 2005/0017912 | A1 | 1/2005 | Azoulay et al. | |
| 2005/0030232 | A1 | 2/2005 | Monebhurrun et al. | |
| 2009/0179804 | A1 | 7/2009 | Liu | |

FOREIGN PATENT DOCUMENTS

| | | | |
|---|---|---|---|
| EP | 1 469 553 | A1 | 10/2004 |
| EP | 1 469 554 | A1 | 10/2004 |
| EP | 2 079 130 | A1 | 7/2009 |
| FR | 2616015 | A1 | 12/1988 |
| JP | 2005-086794 | A | 3/2005 |
| WO | WO 98/43313 | A1 | 10/1998 |
| WO | WO 03/103087 | A2 | 12/2003 |

OTHER PUBLICATIONS

Korean Language Office Action dated Jul. 28, 2011.
Yongho Kim, et al., "Study and Reduction of the Mutual Coupling Between Two-L-Shaped Folded Monopole Antennas for Handset", Technical Report of IEICE, Mar. 27, 2008.
Korean Office Action No. 10-2010-0072791 issued Apr. 23, 2012.

* cited by examiner

*Primary Examiner* — Hoang V Nguyen
(74) *Attorney, Agent, or Firm* — Arent Fox LLP

(57) ABSTRACT

An antenna includes a dielectric substrate and an antenna element. The antenna element includes a power feeding element and a reference potential element. The power feeding element includes a first conductive layer formed over the dielectric substrate, the first conductive layer extending in a first direction and having a first length along the first direction. The reference potential element includes a second conductive layer formed over the dielectric substrate, the second conductive layer extending in a second direction opposed to the first direction from a second position, the second point being apart by a first distance from a first position on an end of the first conductive layer, and a third conductive layer formed over the dielectric substrate, the third conductive element extending from the second point in the first direction apart by a second distance from the first conductive layer and having a third length along the first direction.

20 Claims, 14 Drawing Sheets

ANTENNA AND COMMUNICATION DEVICE INCLUDING THE SAME

CROSS-REFERENCE TO RELATED APPLICATION

This application is based upon and claims the benefit of priority of the prior Japanese Patent Application No. 2009-176649, filed on Jul. 29, 2009 the entire contents of which are incorporated herein by reference.

FIELD

The embodiments discussed herein are related to an antenna and a communication device including the same.

BACKGROUND

In wireless communication, e.g., wireless LAN (Local Area Network) and mobile WiMAX (Worldwide Interoperability for Microwave Access), the service of which has launched in recent years, the supply of a communication device including a downsized antenna has been requested by the market. Such a new wireless communication standard tends to allocate frequency band or bands different from one country or region to another. Therefore, the communication device to be supplied to the market is desired to be compatible with all of these different frequency bands. This is because the development of different communication devices in accordance with the frequency bands for the respective countries or regions results in an undesirable increase in cost. In view of this, it is desired to develop a small wide-band antenna usable even in a mobile environment.

Such an antenna is described in, for example, Japanese Laid-open Patent Publication No. 2005-86794 and Yongho Kim, Jun Ito, and Hisashi Morishita, Department of Electrical and Electronic Engineering, The National Defense Academy, "Study and Reduction of Mutual Coupling between Two L-shaped Folded Monopole Antennas for Handset," *IEICE* (*The Institute of Electronics, Information and Communication Engineers*) *Transaction on Communication*, Mar. 27, 2008.

In WiMAX service, a first frequency band may be allocated for the service in a first country or region, and a second frequency band in a second country or region. At present, for example, a frequency band of 2.5 to 2.7 GHz is allocated for WiMAX service in Japan and a frequency band of 3.4 to 3.6 GHz in Europe. Accordingly a small wide-band antenna and a wireless communication circuit operable in both frequency bands will provide a communication device without replacing the antenna for both bands.

Further, WiMAX employs a MIMO (Multiple Input Multiple Output) communication system. In MIMO, a plurality of transmitting antennas and receiving antennas are provided to simultaneously communicate different communication signal sequences from a plurality of transmitting antennas through channels in the same frequency band, to thereby achieve a substantial increase of efficiency in frequency as a resource.

In this case, if the plurality of antennas are placed in proximity to one another, the mutual coupling thereof is enhanced to result in failure of the realization of the MIMO communication system. Accordingly, it is desired to provide a plurality of antennas contributing to a reduction in required space and weakly coupled to one another.

SUMMARY

According to an aspect of the invention, an antenna includes a dielectric substrate and an antenna element. The antenna element includes a power feeding element and a reference potential element. The power feeding element includes a first conductive layer formed on the dielectric substrate, the first conductive layer extending in a first direction and having a first length along the first direction. The reference potential element includes a second conductive layer formed on the dielectric substrate, the second conductive layer extending in a second direction opposed to the first direction from a second position, the second point being apart by a first distance from a first position on an end of the first conductive layer, and a third conductive layer formed on the dielectric substrate, the third conductive element extending from the second point in the first direction apart by a second distance from the first conductive layer and having a third length along the first direction.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Figure 1A:
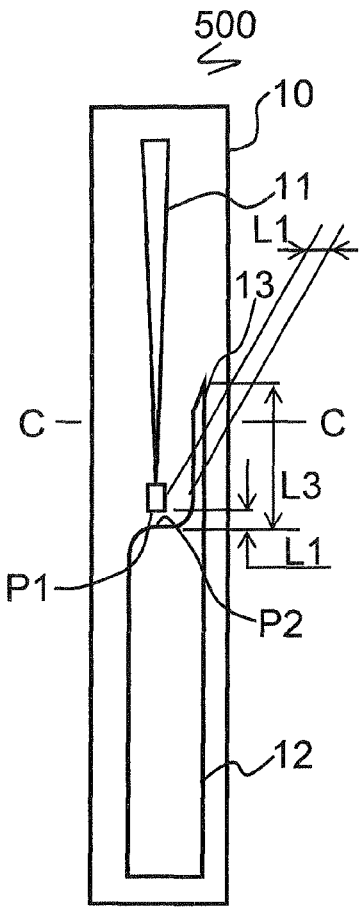
FIGS. 1A to 1E are configuration diagrams of antennas according to a first embodiment.
Figure 1B:
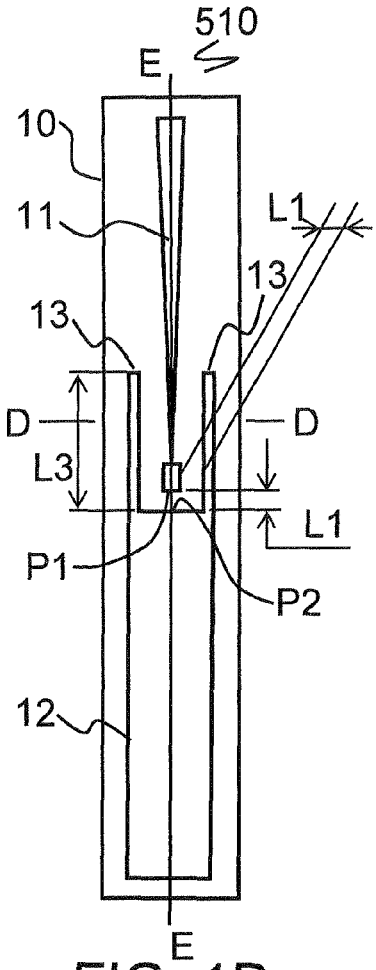
Figure 1E:
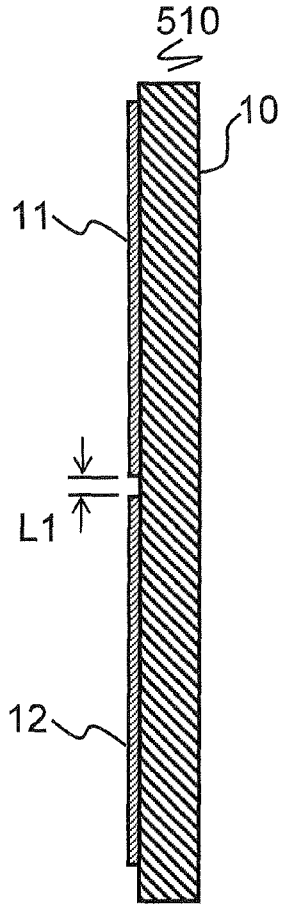
Figure 1C:
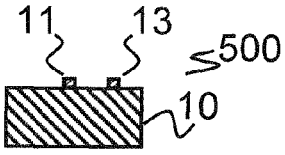
Figure 1D:
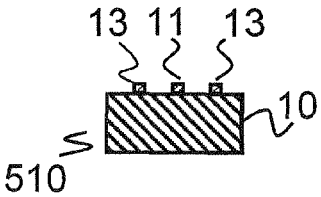

FIGS. 1A to 1E are configuration diagrams of antennas 500 and 510 according to a first embodiment. In FIGS. 1A and 1C illustrates the antenna 500 and FIGS. 1B, 1D, and 1E illustrate the antenna 510. As illustrated in FIGS. 1A and 1B, the each of antennas 500 and 510 comprises conductive layers 11, 12, and 13 formed over a surface of a dielectric substrate 10. The shape of the dielectric substrate 10 is not limited to the shape depicted in FIGS. 1A and 1B. FIGS. 1C and 1D illustrate cross-sectional views taken along the lines C-C and D-D, respectively, indicated in FIGS. 1A and 1B. FIG. 1E illustrates the cross-section a cross-sectional view taken along the line E-E in FIG. 1B. Each of elements with the same reference numeral has a similar or an equivalent function, hereinafter.

Referring to FIGS. 1A and 1B, the dielectric substrate 10 is a substrate formed by a base material such as a polyimide film or a liquid crystal polymer film, for example. The substrate may also be formed by a glass epoxy resin laminated plate material. The thickness of the substrate 10 is set in 25 μm units. The substrate of the antennas 500 and 510 has a thickness of approximately 0.043 mm, for example, including a copper foil of a thickness of 18 μm, which forms a conductive layer described below, and a dielectric constant $\in_r$ of the dielectric substrate 10 is approximately 4.0 to 4.8 at 1 MHz, for example. On a surface of the dielectric substrate 10, there is formed with a first conductive layer 11 forming a power feeding element, a second conductive layer 12 forming a reference potential element applied with a reference potential such as a ground potential, and a third conductive layer 13 extending from the second conductive layer 12.

The first conductive layer 11 forming the power feeding element extends from a first position P1 in a first direction corresponding to the vertically upward direction in the plan views illustrated in FIGS. 1A and 1B, and has a first length. At the first position P1, a transmitted signal is applied or a received signal is induced. The first conductive layer 11 in FIGS. 1A and 1B have a shape narrow at the first position P1 and gradually increase in width toward the leading end thereof. However, the first conductive layer 11 may also have a band-like shape having a constant width, as described later. In FIGS. 1A and 1B, the portion P1 may be a member having a shape sufficient to be connected to a lead, such as a round.

The second conductive layer 12 forming the reference potential element extends from a second position P2, which is separated from the first position P1 by a certain distance L1, in a second direction corresponding to the vertically downward direction in the plan views illustrated in FIGS. 1A and 1B, and has a second length. The width of the second conductive layer 12 is greater than the width of the first conductive layer 11, but may be approximately the same as the width of the first conductive layer 11. Further, the second position P2 of the second conductive layer 12 is applied with the reference potential such as the ground potential.

For example, an internal conductor of a coaxial cable connected to a communication circuit substrate, not-illustrated in FIGS. 1A to 1E, is connected to the first position P1 of the first conductive layer 11, and an external conductor of the coaxial cable is connected to the second position P2 of the second conductive layer 12.

The antenna including the power feeding element formed by the first conductive layer 11 and the reference potential element formed by the second conductive layer 12 is equivalent in configuration to a dipole antenna. That is, the application of a signal of a radio frequency between the first and the second positions P1 and P2 generates an electromagnetic wave transmitted into the air by the first and the second conductive layers 11 and 12. Conversely, the arrival of the electromagnetic wave induces a voltage or a signal between the first and the second positions P1 and P2, which is a reception of a signal of a radio frequency.

In the case of the dipole antenna, the length of the first conductive layer 11 is set to λ/4, i.e., a quarter of a signal wavelength λ in the used band. Conversely, the antenna resonates with a frequency corresponding to one equivalent to the first length of the first conductive layer 11, and has a frequency band corresponding to the width of the first conductive layer 11. Further, the length of the second conductive layer 12 forming the reference potential element is similarly λ/4.

In each of the antennas 500 and 510 according to the present embodiment, the reference potential element further includes the third conductive layer 13 which extends from the second position P2 of the second conductive layer 12 in the first direction described above, and which is located at a position separated from the first conductive layer 11 by the certain distance L1. In the example of FIG. 1B, the third conductive layer 13 is provided on both sides of the first conductive layer 11. However, the third conductive layer 13 may also be provided on one side of the first conductive layer 11, as in the example of FIG. 1A.

Further, a third length L3 of the third conductive layer 13 is preferably less than half the first length of the first conductive layer 11. More preferably, the third length L3 is approximately λ/12 to λ/8, when the wavelength of a certain frequency in the frequency band of the present antenna is represented as λ (e.g., 2.5 GHz).

Since the first conductive layer 11 and the third conductive layer 13 are formed over the dielectric substrate 10, a dielectric material is provided therebetween. Accordingly, by the arrangement of the third conductive layer 13, a capacitance is also formed between the first and the second conductive layers 11 and 13, and a voltage is generated by induction caused by a high frequency signal applied to the first conductive layer 11 or by an incoming electromagnetic wave. As a result, radio waves are radiated or are received. The frequency of the radio waves generated by the above-described operation between the conductive layers 11 and 13 is considered to have a resonance frequency different from that of the frequency generated between the first and the second conductive layers 11 and 12. As a result, the frequency band of each of the antennas 500 and 510 is wider than that of a dipole antenna including those similar to or equivalent to the first and second conductive layers 11 and 12. The antenna length of a half-wavelength (λ/2) dipole antenna is obtained as below:

$$\text{the antenna length}=\lambda/2=C/2f,$$

where λ is a free-space wavelength, C is a velocity of light ($3\times10^8$ m/sec), and f is a frequency. Accordingly, the antenna length is 60 mm in the case that the frequency is 2.5 GHz. In this case, the antenna length of the half-wavelength dipole antenna may be 60 mm+L1 when the power feeding element and the reference potential element are formed over a same plane or a surface. However, when the power feeding element and the reference potential element are formed over different surfaces of dielectric substrate 10 respectively, the antenna length may be shorten due to a specific permittivity. A fractional shortening is a ratio by which the antenna is shorten and the fractional shortening is expressed as below:

$$\text{the fractional shortening}=\lambda g=\lambda/\sqrt{\in_r},$$

where $\in_r$ is the specific permittivity, for example, 4.0~4.8.

Figure 2:
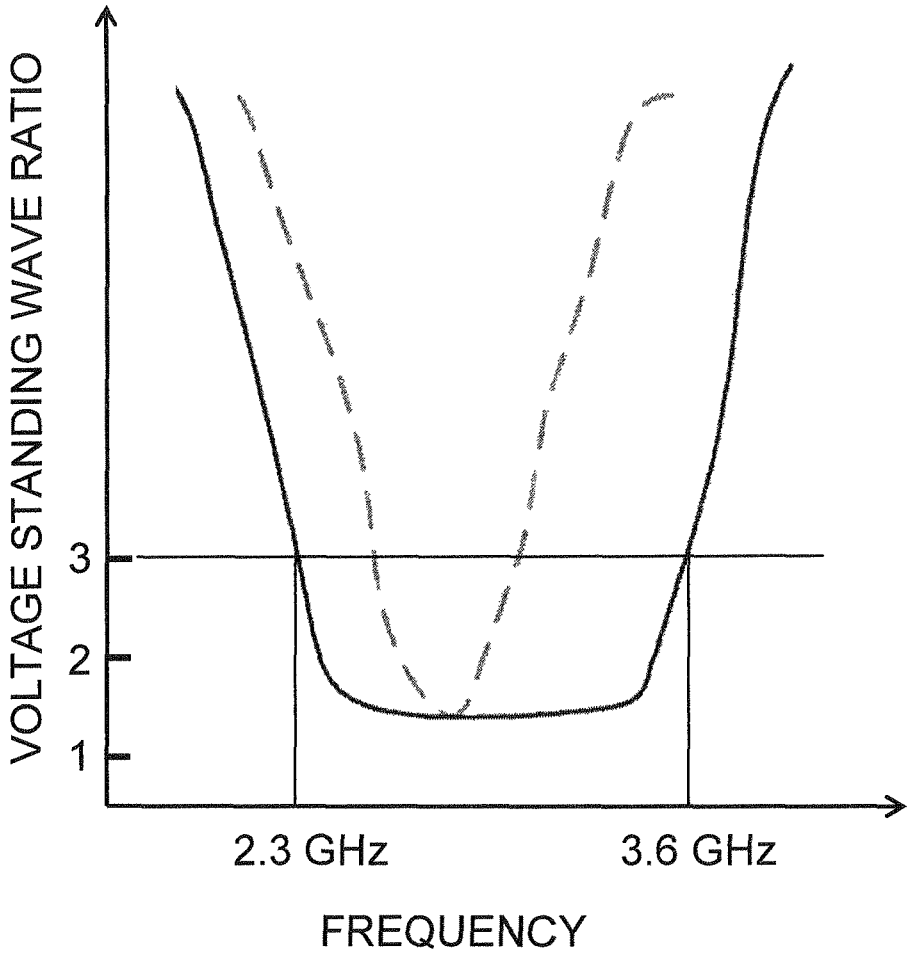
FIG. 2 is a diagram illustrating the reflection coefficient with respect to the frequency of the antennas according to the first embodiment.

FIG. 2 is a diagram illustrating the voltage standing wave ratio (VSWR), corresponding to the reflection coefficient, with respect to the frequency of the antenna according to the first embodiment. The horizontal axis represents the frequency, and the vertical axis represents the voltage standing wave ratio. This result was obtained from an experiment conducted by the present inventor. In a frequency band of a low reflection coefficient, that is, a low VSWR, the radio waves radiated from the antenna are transmitted with a small amount of reflection. Therefore, the band corresponding to the low reflection coefficient is suitable for a band for the antenna use. In FIG. 2, the dotted line represents the frequency characteristic of the reflection coefficient of a conventional dipole antenna. Further, the solid line represents the frequency characteristic of the reflection coefficient of the antenna according to the first embodiment. Obviously, comparing both reflection coefficient characteristics, the characteristic of the solid line has a low reflection coefficient up to a higher frequency than a frequency at which the reflection coefficient represented by the dotted line is low. Accordingly, the characteristic of the solid line has a frequency band fairly wider than that of the characteristic of the dotted line. Further, the frequency band is also somewhat spread in a lower frequency region in the characteristic represented by the solid line than in the characteristic represented by the dotted line.

The distance between the first conductive layer 11 and the second conductive layer 12, i.e., the distance L1 between the first position P1 and the second position P2 is approximately λ/80 to λ/60, which is substantially the same as the distance L1 between the first conductive layer 11 and the third conductive layer 13. The distance L1 is preferably selected as a distance for matching the input impedance of the antenna to 50Ω, when the first position P1 applied with a power feeding voltage and the second position P2 applied with a reference voltage form an input terminal pair. With the input impedance of the antenna matched to 50Ω, it is possible to couple the antenna to a communication circuit device, not-illustrated, by using a highly versatile coaxial cable, a microstrip line, and so forth having a characteristic impedance of 50Ω. Accordingly, it is possible to achieve impedance matching without using a component such as a coil and a capacitor, and to reduce the matching loss of the high-frequency signal between the input terminals and suppress the reflection.

According to the antennas 500 and 510 illustrated in FIGS. 1A to 1E experimentally produced by the present inventor, the frequency bands thereof in which the VSWR is equal to or less 3, were successfully increased to 2.3 to 3.6 GHz. As a result, the fractional bandwidth thereof is represented as follows:

$$\text{Bandwidth (\%)} = (\text{frequency bandwidth}/\text{center frequency}) \times 100$$

$$= \left\{\frac{(\text{high freq} - \text{low freq})}{[(\text{high freq} - \text{low freq}/2) + \text{low freq}]}\right\} \times 100,$$

where freq is referred to as frequency. The fractional bandwidth of this case is $(3.6-2.3)/\{(3.6-2.3)/2+2.3\} \approx 0.441 = 44.1\%$. Further, a trial product of the antenna 500 including the third conductive layer 13 on one side of the first conductive layer 11 forming the power feeding element and a trial product of the antenna 510 including the third conductive layer 13 on both sides of the first conductive layer 11 were examined. The examination confirmed that both of the trial products of the antennas 500 and 510 have a characteristic in which the reflection coefficient, as illustrated in FIG. 2, decreases in a wide frequency band. The examination also confirmed that the reflection is somewhat reduced in a low frequency band in the trial product of the antenna 500 including the third conductive layer 13 on one side of the first conductive layer 11, and that the reflection is somewhat reduced in a high frequency band in the trial product of the antenna 510 including the third conductive layer 13 on both sides of the first conductive layer 11.

Further, trail products different from one another in the length L3 of the third conductive layer 13 were examined. The examination confirmed that the antenna has a characteristic in which, as the length L3 is reduced to be shorter than λ/4, the reflection coefficient becomes lower while the frequency band corresponding to the low reflection coefficient shifts from a low band to a high band, and in which the reflection coefficient is the lowest in a wide frequency band when the length L3 is an optimal length of λ/8 to λ/12. The examination also confirmed that, according to if the length L3 is equal to or shorter than λ/4, the reflection coefficient decreases while the frequency band corresponding to the low reflection coefficient shifts to a higher band, to eventually provide the dipole antenna characteristic represented by the dotted line.

Figure 3A:
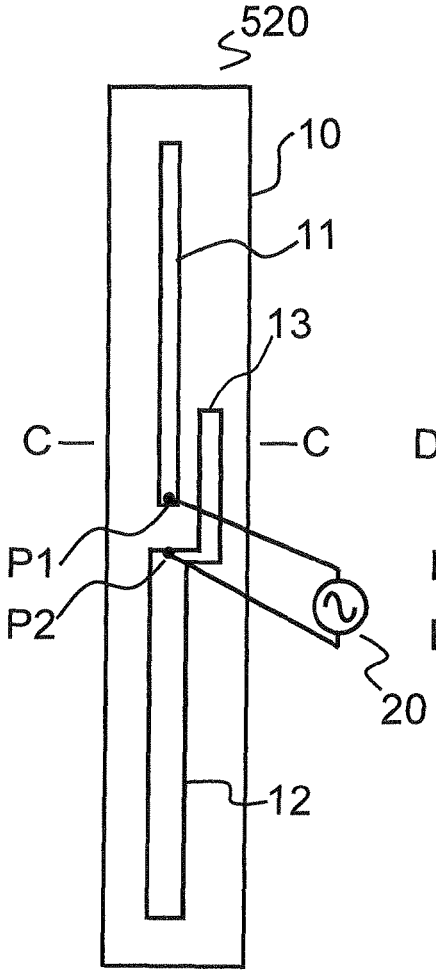
FIGS. 3A to 3E are diagrams illustrating configurations of antennas according to the first embodiment.
Figure 3B:
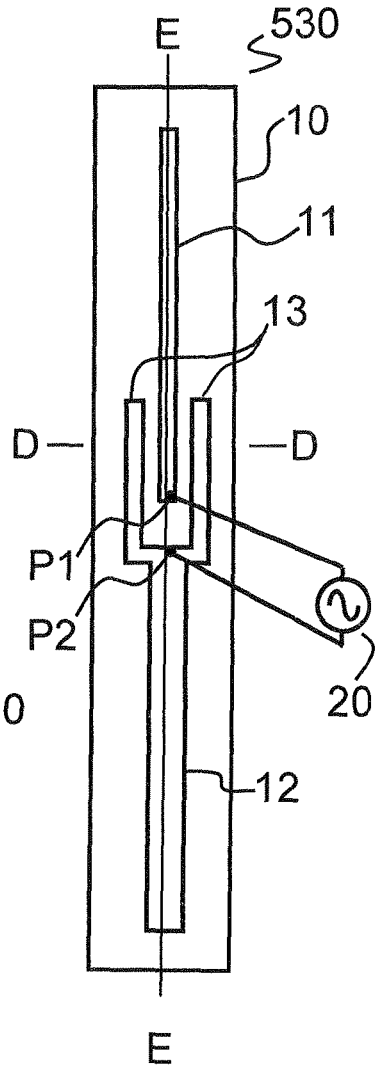
Figure 3E:
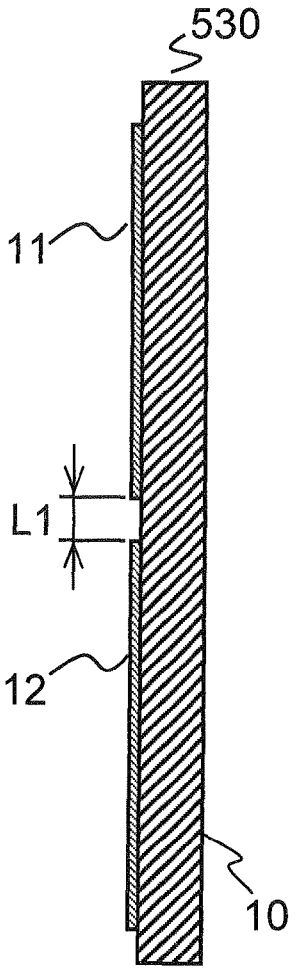
Figure 3C:
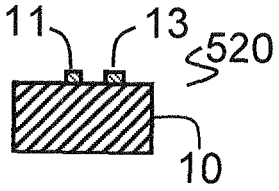
Figure 3D:
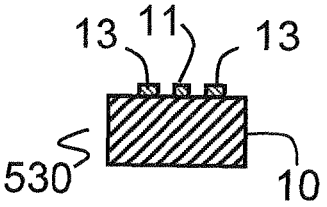

FIGS. 3A to 3E are diagrams illustrating antennas 520 and 530 as other configurations according to the first embodiment. Each of the antennas 520 and 530 includes, on a first surface of the dielectric substrate 10, the first conductive layer 11 formed into a band-like shape having a constant width and extending in the vertically upward direction as illustrated in FIGS. 3A and 3B, the second conductive layer 12 formed into a band-like shape having a constant width, separated from the first conductive layer 11 by the certain distance L1, and extending in the vertically downward direction as illustrated in FIGS. 3A and 3B, and the third conductive layer 13 separated from the first conductive layer 11 by the certain distance L1, and extending in the vertically upward direction from the second position P2. Cross-sectional structures of the present antennas 520 and 530 are the same as those of the antennas 500 and 510 illustrated in FIGS. 1C, 1D, and 1E. Further, a transmitted signal 20 is supplied to or induced between the first position P1 and the second position P2, and radio waves corresponding to the signal are transmitted or received.

In the plan view of FIG. 3B, the third conductive layer 13 is provided on both sides of the first conductive layer 11. However, the conductive layer 13 may also be configured such that the third conductive layer 13 is provided on one side of the first conductive layer 11, as in the plan view of the antenna 520 illustrated in FIG. 3A.

FIGS. 4A to 4E are diagrams illustrating antennas 540 and 550 as other configuration of the antenna according to the first embodiment. In the present antennas, the first conductive layer 11 forming the power feeding element is provided on the first surface of the dielectric substrate 10, and the second and third conductive layers 12 and 13 forming the reference potential element are provided on the second surface of the dielectric substrate 10 opposite to the first surface.

With these configurations, it is possible to reduce the antenna size owing to a high dielectric constant of the dielectric substrate 10 interposed between the power feeding element, such as the first conductive layer 11, and the reference potential element, such as the second and third conductive layers 12 and 13. Similarly, it is possible to reduce the size of the antenna having the configurations illustrated in FIGS. 3A to 3E by forming the power feeding element and the reference potential element on the first surface and the second surface of the dielectric substrate 10, respectively. As illustrated in FIG. 4B, the antenna 550 has the third conductive layer 13 is provided on both sides of the first conductive layer 11, while the antenna 540 illustrated in FIG. 4A has the third conductive layer 13 provided on one side of the first conductive layer 11. Either one of the configurations may be used.

Figure 5A:
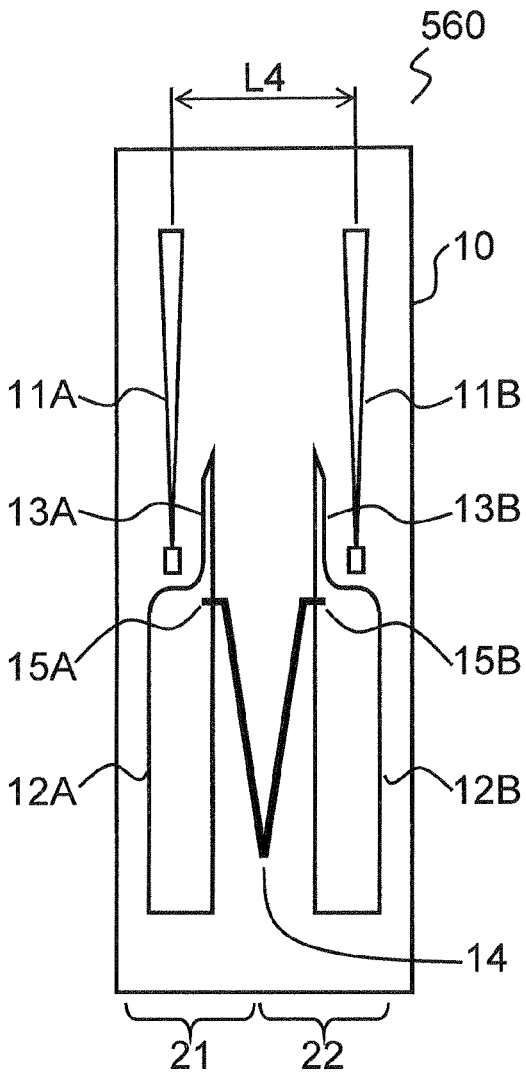
FIGS. 5A and 5B are diagrams illustrating configurations of antennas according to a second embodiment.
Figure 5B:
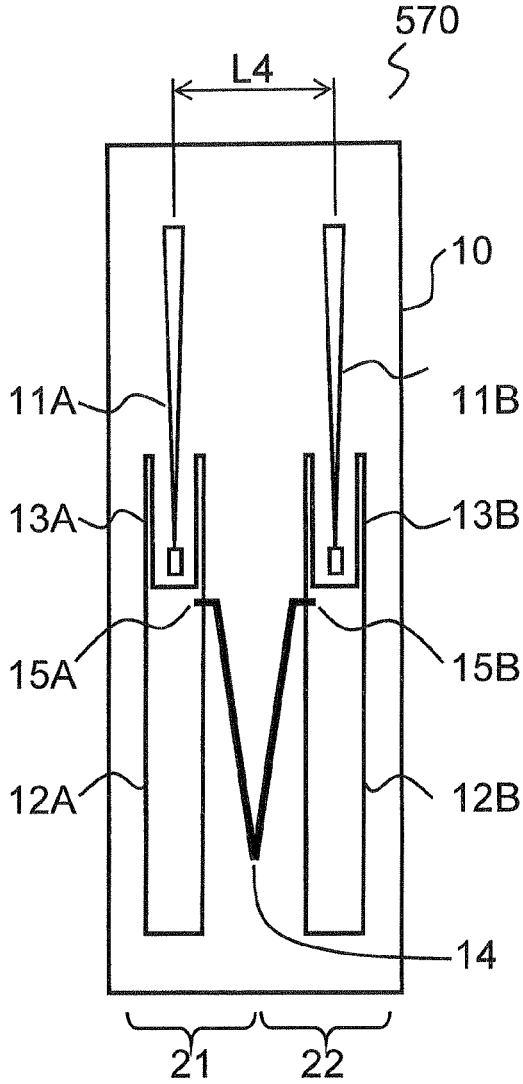

FIGS. 5A and 5B are diagrams illustrating configurations of the antennas according to a second embodiment. Each of the antennas 560 and 570 includes the first and the second antenna elements 21 and 22 arranged side by side on the dielectric substrate 10 which include first conductive layers 11A and 11B forming power feeding elements; the second conductive layers 12A and 12B; and the third conductive layers 13A and 13B. The second and third conductive layers 12A, 12B, 13A, and 13B form reference potential elements.

Each of the antennas 560 and 570 further includes a short-circuiting conductive layer 14 provided on the dielectric substrate 10, having a fourth length, and coupling the second conductive layers 12A and 12B of the first and second antenna elements 21 and 22. The antenna 560 has the symmetrical reference potential elements of the first and the second antenna elements 21 and 22, and the corresponding dimensions of the first and second antenna elements 21 and 22 are equivalent or close to each other, while those of the antenna 570 are the same in the shape and size of the power feeding elements and the reference potential elements. Therefore, the first and second antenna elements 21 and 22 have the respective frequency band similar or same to each other, and each of them is usable as a MIMO antenna.

Further, the second conductive layers 12A and 12B of the first and second antenna elements 21 and 22 of the antennas 560 and 570 are coupled by the short-circuiting conductive layer 14 having the fourth length. The short-circuiting conductive layer 14 is coupled to the second conductive layers 12A and 12B at coupling points 15A and 15B thereof, respectively.

When radio waves of the same frequency are transmitted from a plurality of antennas, such as a MIMO antenna, it is undesirable that a high proportion of radio waves transmitted from one of the antennas is absorbed by the other antenna. This is because, if the degree of coupling between two antennas is high, as in this case, the plurality of antennas are prevented from transmitting radio waves of different signals. In general, therefore, a distance L4 between the first and second antenna elements 21 and 22 is set to be λ/4 or more. However, this configuration obstructs a reduction in size of the antenna.

However, the present inventor has found that it is possible to reduce the degree of coupling by providing the short-circuiting conductive layer 14 as described above. That is, even if the distance L4 between the first and second antenna elements 21 and 22 is reduced to be less than λ/4, it is possible to provide an antenna pair having a sufficiently low degree of coupling.

FIG. 5B illustrates an example in which the third conductive layer 13A or 13B is provided on both sides of the first conductive layer 11A or 11B in each of the paired antenna elements 21 and 22, while FIG. 5A illustrates an example in which the third conductive layer 13A or 13B is provided on one side of the first conductive layer 11A or 11B in each of the paired antenna elements 21 and 22. Either one of the configurations may be used.

The antenna pair of FIGS. 5A and 5B may be configured such that the first conductive layers 11A and 11B are formed over the first surface of the dielectric substrate 10, and that the second and third conductive layers 12A, 12B, 13A, and 13B are formed over the second surface of the dielectric substrate 10, as in the configuration of FIGS. 4A to 4E.

Figure 6:
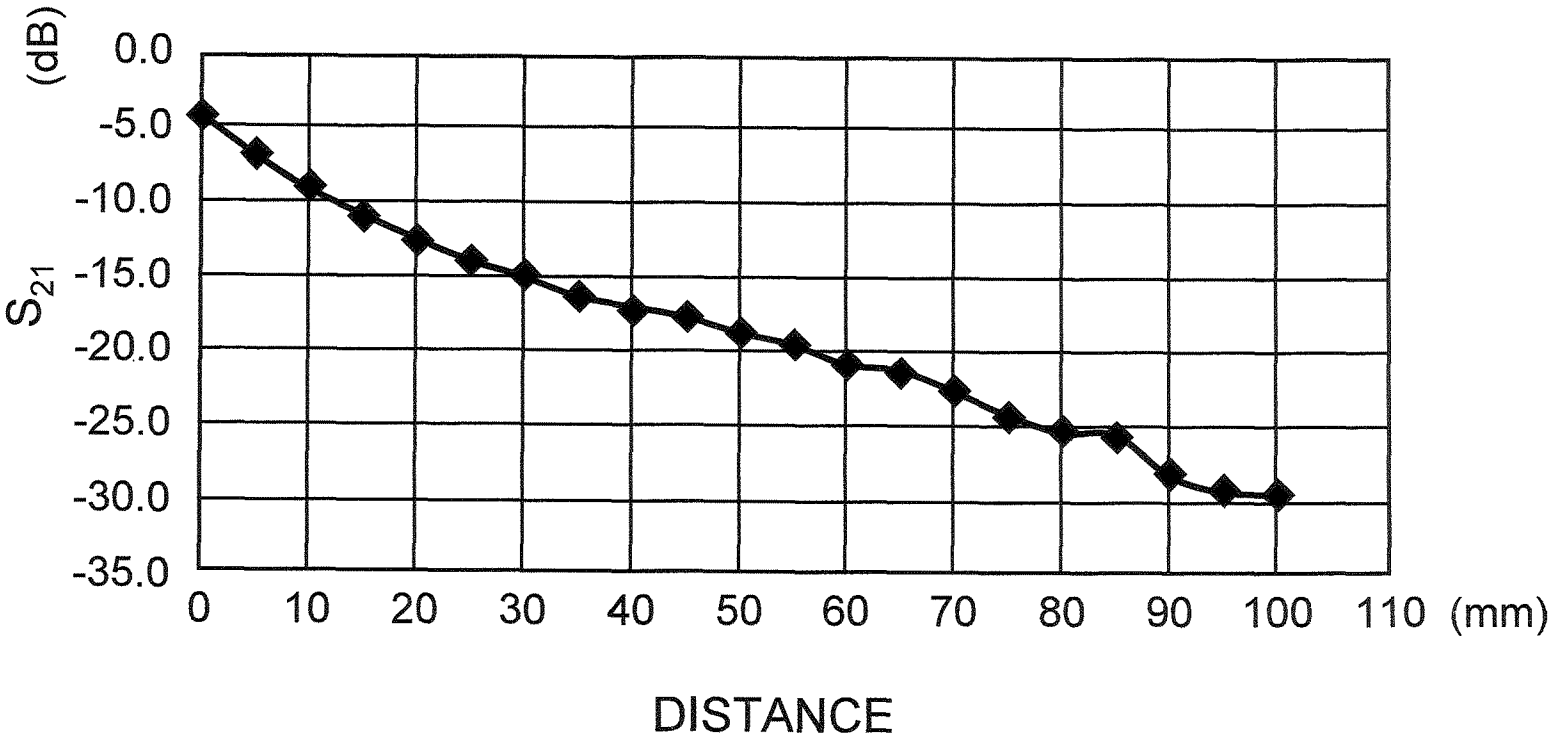
FIG. 6 is a graph illustrating the degree of coupling between antennas.

FIG. 6 is a graph illustrating the degree of coupling between the antenna elements 21 and 22. The horizontal axis represents the distance L4 between the antennas, and the vertical axis represents the degree of coupling $S_{21}$. The degree of coupling corresponds to the attenuation amount of the radio waves transmitted from one of the antennas. A smaller attenuation amount indicates a lower degree of coupling. FIG. 6 illustrates the degree of coupling of the antenna pair in FIGS. 5A and 5B not including the short-circuiting conductive layer 14. A distance 30 mm corresponds to λ/4 where λ is a wavelength when the frequency is 2.5 GHz. If each of the antenna pairs does not include the short-circuiting conductive layer 14, it is desired to set the distance L4 between the antennas to be 30 mm (=λ/4) or more to achieve sufficient isolation between the antennas.

Meanwhile, it was confirmed that the degree of coupling depicted in FIG. 6 is lowered by the provision of the short-circuiting conductive layer 14, as in the configuration of FIGS. 5A and 5B. Therefore, it is possible to reduce the distance L4 between the antennas to be close to a value less than λ/4. As a result, the present antenna may be reduced in size as a MIMO antenna.

The present inventor have found that the antenna pair having the reference potential elements coupled together by the short-circuiting conductive layer 14 of FIGS. 5A and 5B has a characteristic in which substantial attenuation occurs in a specific frequency owing to the provision of the short-circuiting conductive layer 14. This attenuation characteristic in a specific narrow frequency band exists separately from and independently of the above-described reduction characteristic of the degree of coupling between the antennas. Further, if the respective positions of the coupling points 15A and 15B of the short-circuiting conductive layer 14 are changed, the specific frequency band may be changed. Further, if the length of the short-circuiting conductive layer 14 is changed, the attenuation rate may be changed.

Figure 7A:
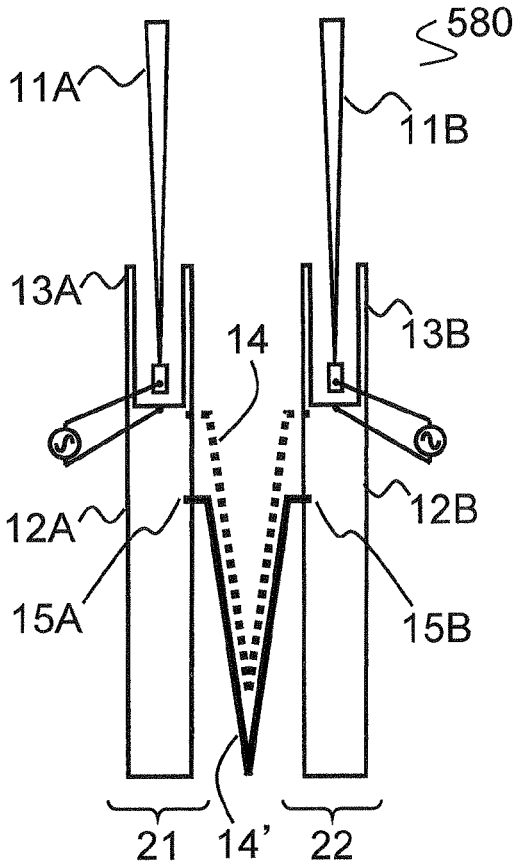
FIGS. 7A to 7C are diagrams illustrating characteristics of the antennas according to the second embodiment.
Figure 7B:
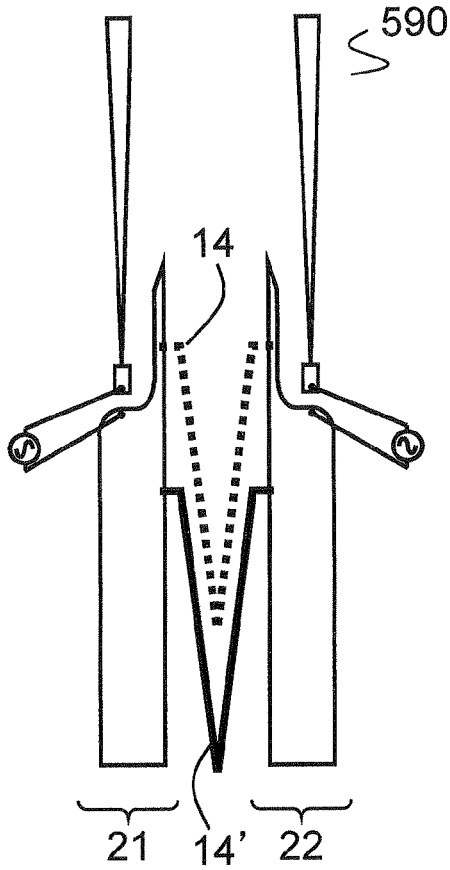
Figure 7C:
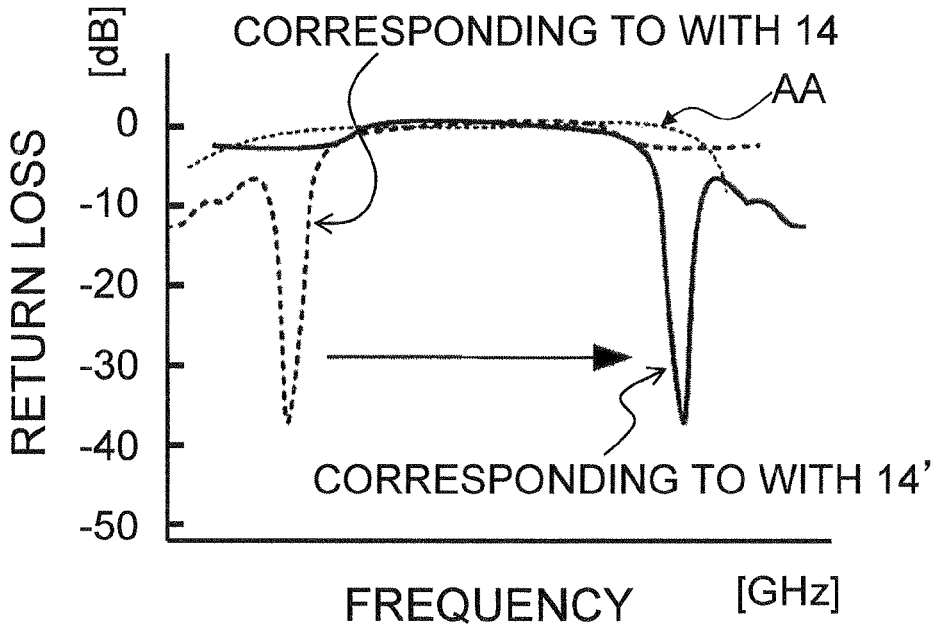

FIGS. 7A to 7C are diagrams explaining a characteristic of the antennas 580 and 590 according to the second embodiment. As described above, in the antenna pair of each of antennas illustrated in FIGS. 5A and 5B, if the respective positions of the coupling points 15A and 15B of the short-circuiting conductive layer 14 are changed, the specific frequency band may be changed. As illustrated in FIGS. 7A and 7B, if the coupling points 15A and 15B of the short-circuiting conductive layer 14 are located at respective positions close to the third conductive layers 13A and 13B, as indicated by the dotted lines and a reference numeral 14, the frequency in the specific frequency band may be set to a low value. Meanwhile, if the coupling points 15A and 15B are located at respective positions far from the third conductive layers 13A and 13B, as indicated by the solid lines and a reference numeral 14', the frequency in the specific frequency band may be set to a high value as described below.

FIG. 7C illustrates frequency characteristics increasing the attenuation amount. In FIG. 7C, the dotted line represents the frequency characteristic of the configuration in which the coupling points 15A and 15B of the short-circuiting conductive layer 14 are located at respective positions close to the third conductive layers 13A and 13B. Meanwhile, the solid line represents the frequency characteristic of the configuration in which the coupling points 15A and 15B of the short-circuiting conductive layer 14 are located at respective positions far from the third conductive layers 13A and 13B. A reference line AA represents a characteristic of the attenuation when two antennas are set close to each other. As indicated by the arrow in FIG. 7C, if the respective positions of the coupling points 15A and 15B are changed, the specific frequency band corresponding to a drop in the attenuation rate may be changed. Accordingly, if the above-described specific frequency is set to the frequency band of an external jamming radio signal, which is not desired to be received in wireless communication, the antenna may attenuate the external jamming signal causing radio disturbance.

In particular, WiMAX in Japan partially overlaps in frequency band with Wireless LAN, Wi-Fi (Wireless Fidelity), and Bluetooth. Therefore, if the above-described specific frequency band is matched to such an overlapping frequency band, the radio waves of Wireless LAN may be cut off.

FIG. 7A illustrates an antenna 580 as an example in which the third conductive layer 13A or 13B is provided on both sides of the first conductive layer 11A or 11B in each of the paired antennas, while the plan view of FIG. 7B illustrates an antenna 590 as an example in which the third conductive layer 13A or 13B is provided on one side of the first conductive layer 11A or 11B in each of the paired antennas. A similar characteristic is obtained from both of the configurations. In FIGS. 7A and 7B, the conductive patterns are illustrated for an easily understood manner without a dielectric substrate such as the dielectric substrate 10 in FIGS. 1A and 1B. The elimination may be adopted for the same object.

Figures 8A, 8B:
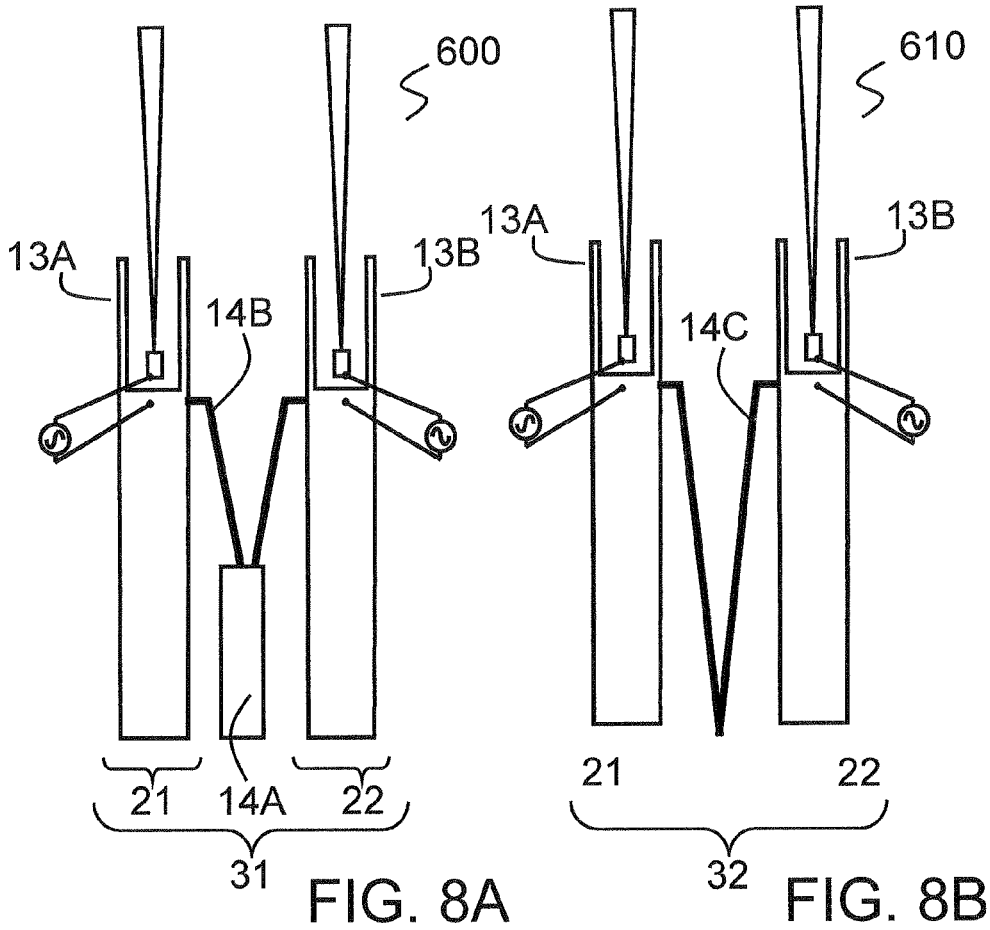
FIGS. 8A to 8C are diagrams illustrating characteristics of the antennas according to the second embodiment.
Figure 8C:
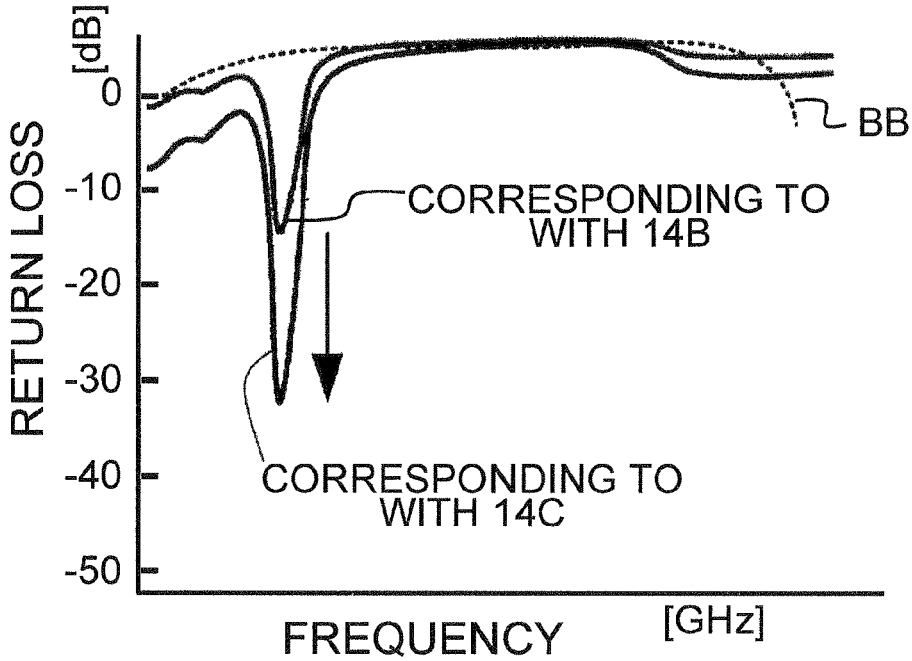

FIG. 8C is a diagram illustrating a characteristic of the antenna according to the second embodiment. As described above, in the antenna pair of FIGS. 5A and 5B, if the length of the short-circuiting conductive layer 14 is changed, the attenuation rate of the antenna pair may be changed. An antenna pair 31 of an antenna 600 illustrated in FIG. 8A is an example including a short-circuiting conductive layer 14B having a short length owing to a conductive layer 14A, while an antenna pair 32 of an antenna 610 is an example including a short-circuiting conductive layer 14C having a length longer than that of the antenna 600.

As illustrated in FIG. 8C, if the length of the short-circuiting conductive layer 14 is short such as the antenna 600, the attenuation rate is reduced. Conversely, if the length of the short-circuiting conductive layer 14 is long such as the antenna 610, the attenuation rate is increased. If the attenuation rate is increased as the antenna 610, however, the attenuation rate is also increased in a frequency band close to the specific frequency band. Therefore, if the length of the short-circuiting conductive layer 14 is appropriately selected, it is possible to reduce the attenuation rate of the specific frequency band to a desired level, without reducing the attenuation rate of a frequency band close to the specific frequency band.

The plan views of FIGS. 8A and 8B only illustrate an example in which the third conductive layer 13A or 13B is provided on both sides of the first conductive layer 11A or 11B in each of the antennas forming the antenna pair. However, an example in which the third conductive layer 13A or 13B is provided on one side of the first conductive layer 11A or 11B is also capable of obtaining a similar characteristic.

Figure 9A:
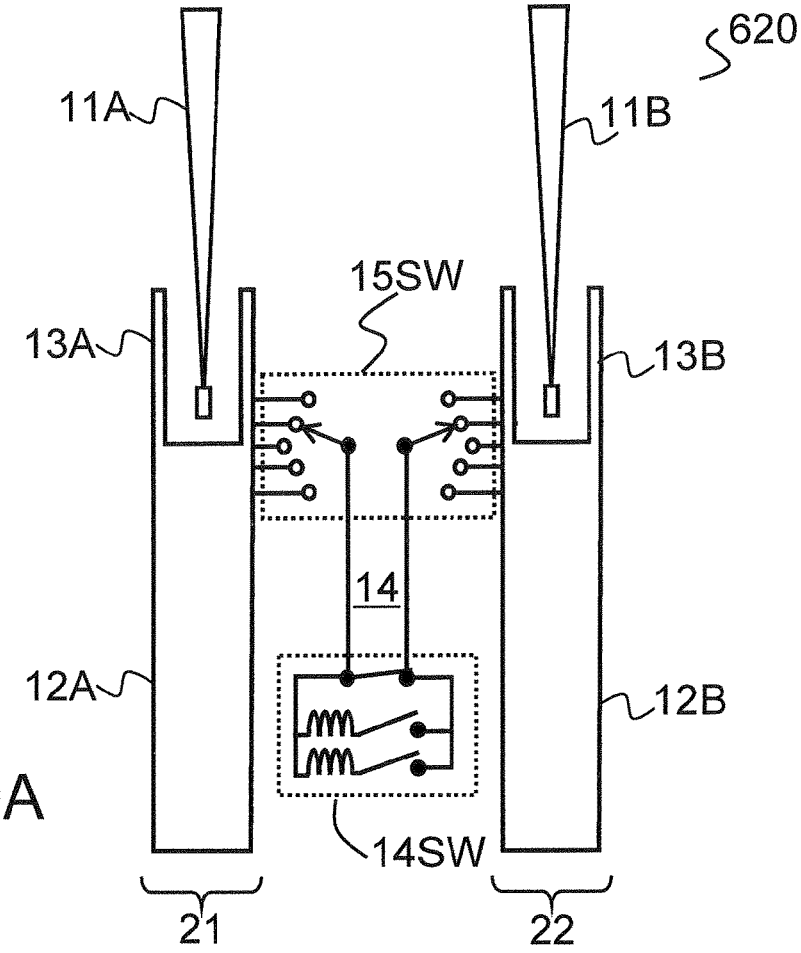
FIGS. 9A and 9B are diagrams illustrating a modified example of the antenna according to the second embodiment.
Figure 9B:
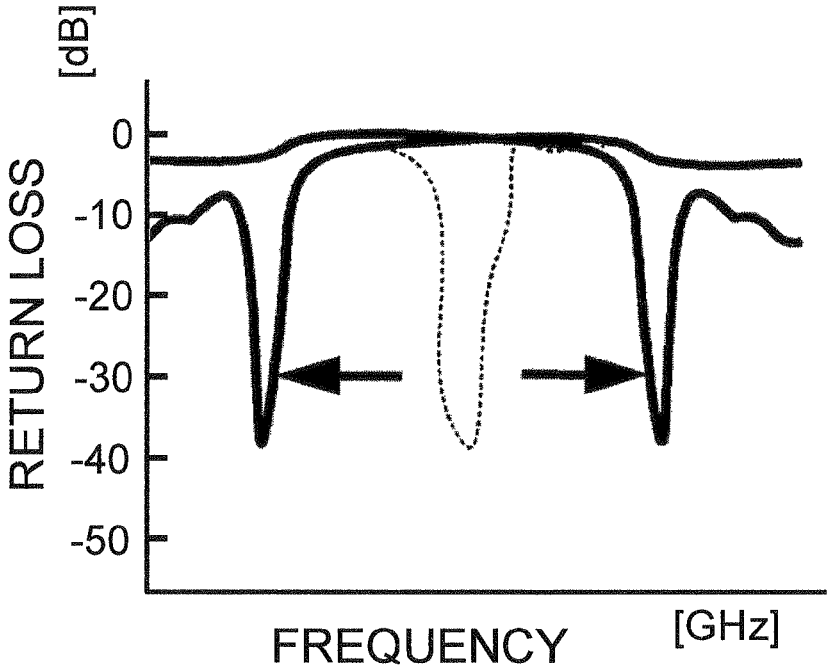

FIGS. 9A and 9B are diagrams illustrating an antenna 620 as a modified example of the antenna according to the second embodiment. As illustrated in FIG. 9A, the antenna 620 includes a coupling point switch group 15SW capable of changing the coupling points of the short-circuiting conductive layer 14 for coupling the second conductive layers 12A and 12B forming the reference potential elements of the paired antennas 21 and 22, and includes a length switch group 14SW capable of changing the length of the short-circuiting conductive layer 14. With one of these switch groups brought into the conductive state, it is possible to set the coupling points to respective desired positions, and to set the length to a desired length.

If the specific frequency band corresponding to the drop in the attenuation rate is selected with the switch group 15SW, and if the level of the attenuation rate is selected with the switch group 14SW, it is possible to reduce the degree of coupling between the antenna pair, and to block the radio waves of the specific frequency band.

Figure 10:
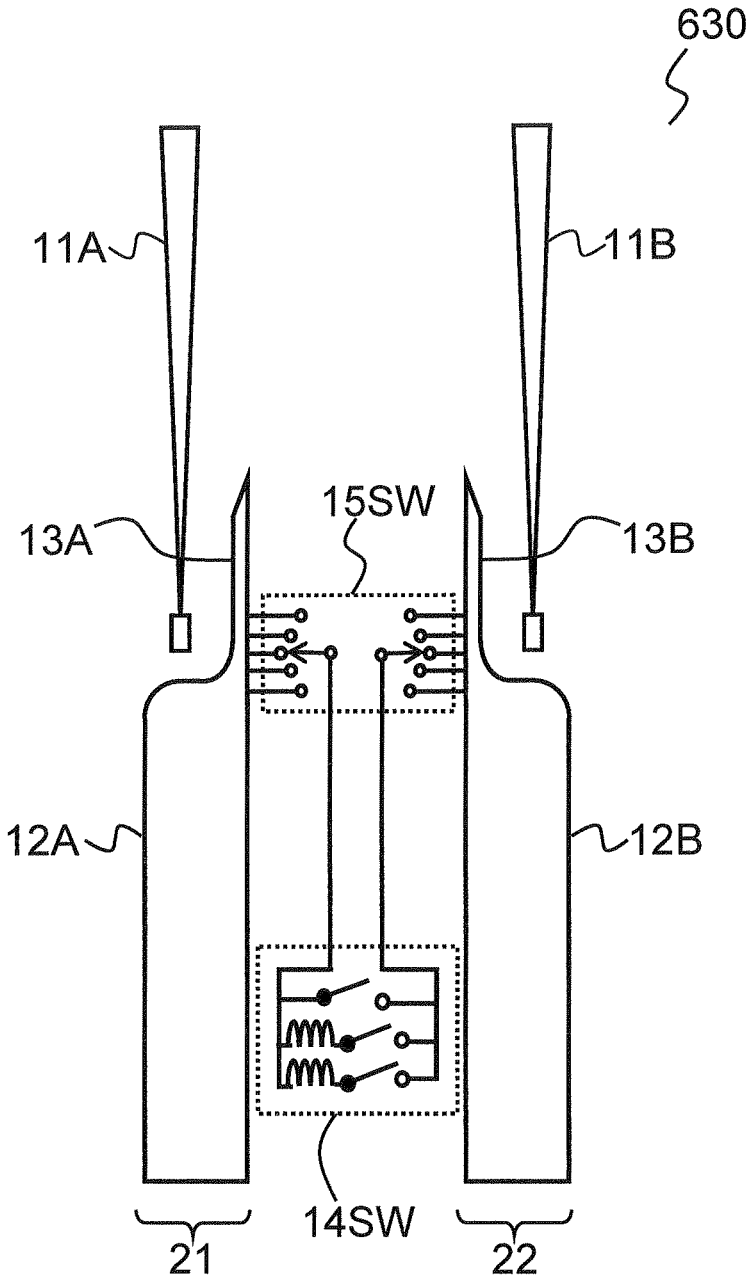
FIG. 10 is a diagram illustrating a modified example of the antenna according to the second embodiment.

FIG. 10 is a diagram illustrating an antenna 630 as a modified example of the antenna according to the second embodiment. In the antenna, the third conductive layer 13A or 13B is provided on one side of the first conductive layer 11A or 11B in each of the antennas, unlike the antenna 620 the example of FIG. 9A. The present structure of the antenna 630 may also be set in a similar manner to the structure of FIG. 9A.

Figure 11A:
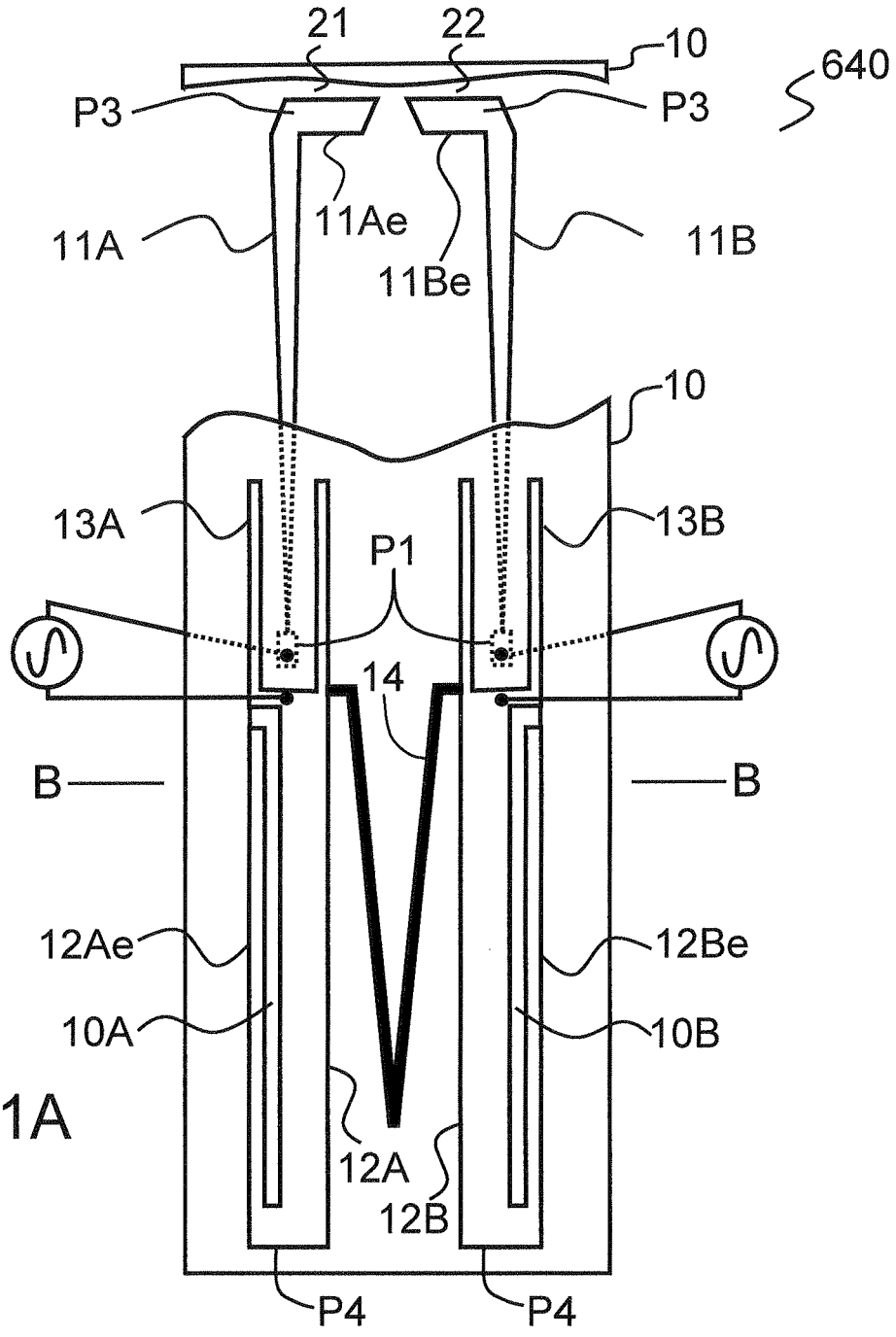
FIGS. 11A and 11B are diagrams illustrating a structure of an antenna according to a third embodiment.
Figure 11B:
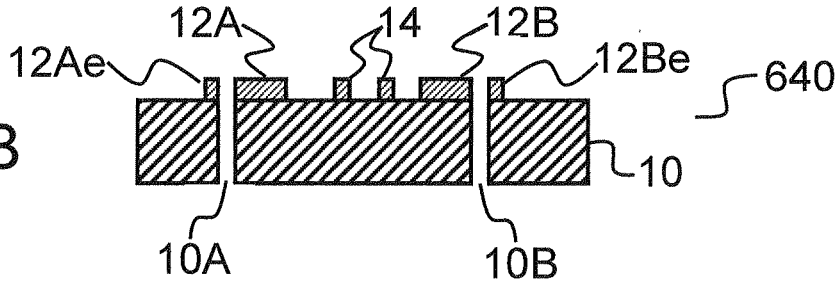

FIGS. 11A and 11B are diagrams illustrating a structure of an antenna 640 according to a third embodiment. In the paired antennas 21 and 22, the antenna 21 includes a fourth conductive layer 11Ae extending in the horizontal direction from a third position P3 opposite to the first position P1 of the first conductive layer 11A forming the power feeding element as illustrated. Similarly, the antenna 22 includes a fourth conductive layer 11Be extending in the horizontal direction from the third position P3.

The antenna 21 further includes a fifth conductive layer 12Ae separated from the second conductive layer 12A and extending in the vertically upward direction in FIG. 11A from a fourth position P4 of the second conductive layer 12A forming the reference potential element. Similarly, the antenna 22 includes a fifth conductive layer 12Be extending in the vertically upward direction from the fourth position P4.

Further, in both of the two antennas 21 and 22, the first conductive layers 11A and 11B and the fourth conductive layers 11Ae and 11Be forming the power feeding elements are formed over one planar surface of the dielectric substrate 10. Further, the second conductive layers 12A and 12B and the fifth conductive layers 12Ae and 12Be forming the reference potential elements are formed over the other planar surface of the dielectric substrate 10. Further, as illustrated in the cross section taken along the line B-B, respective portions of the dielectric substrate 10 located between the second conductive layers 12A and 12B and the fifth conductive layers 12Ae and 12Be are removed, as indicated by the reference numerals 10A and 10B.

Figure 4A:
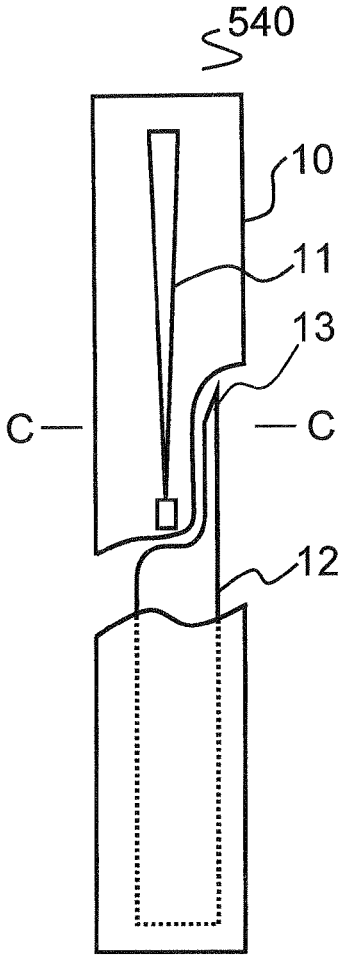
FIGS. 4A to 4E are diagrams illustrating configurations of antennas according to the first embodiment.
Figure 4B:
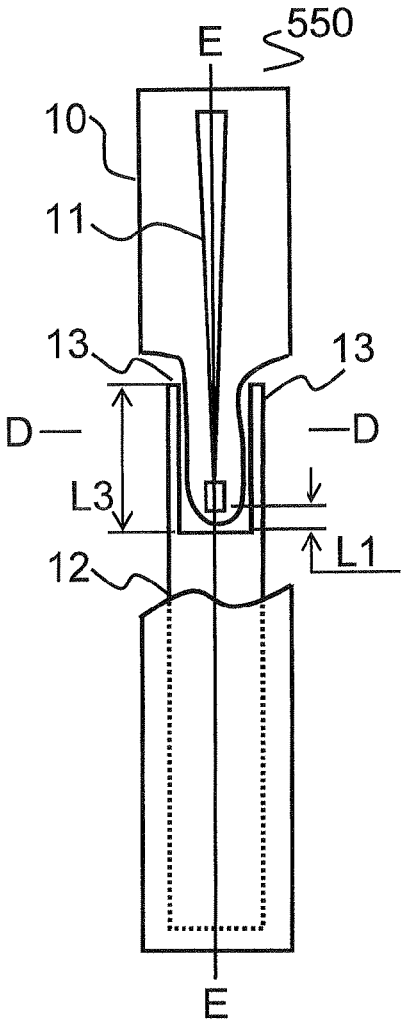
Figure 4E:
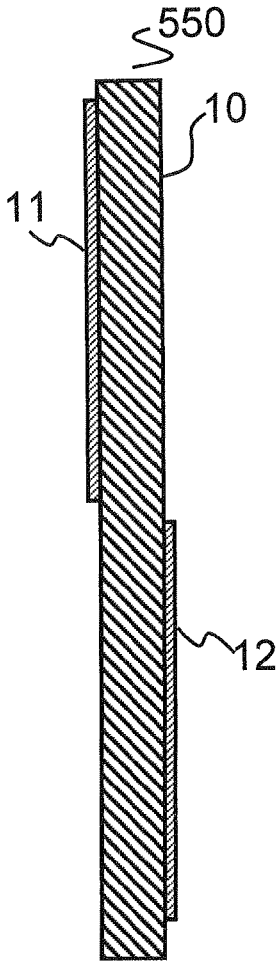
Figure 4C:
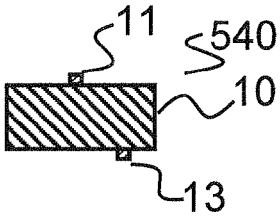
Figure 4D:
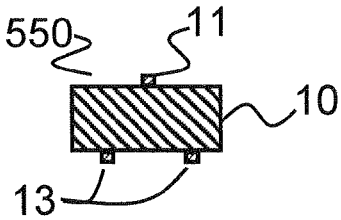

If both of the power feeding elements and the reference potential elements are thus configured to have a long length and separately provided on the opposite surfaces of the dielectric substrate 10, the antennas in FIGS. 4A and 4B may become smaller than the antennas in FIGS. 3A and 3B, provided that the power feeding elements have the same length.

Figure 12A:
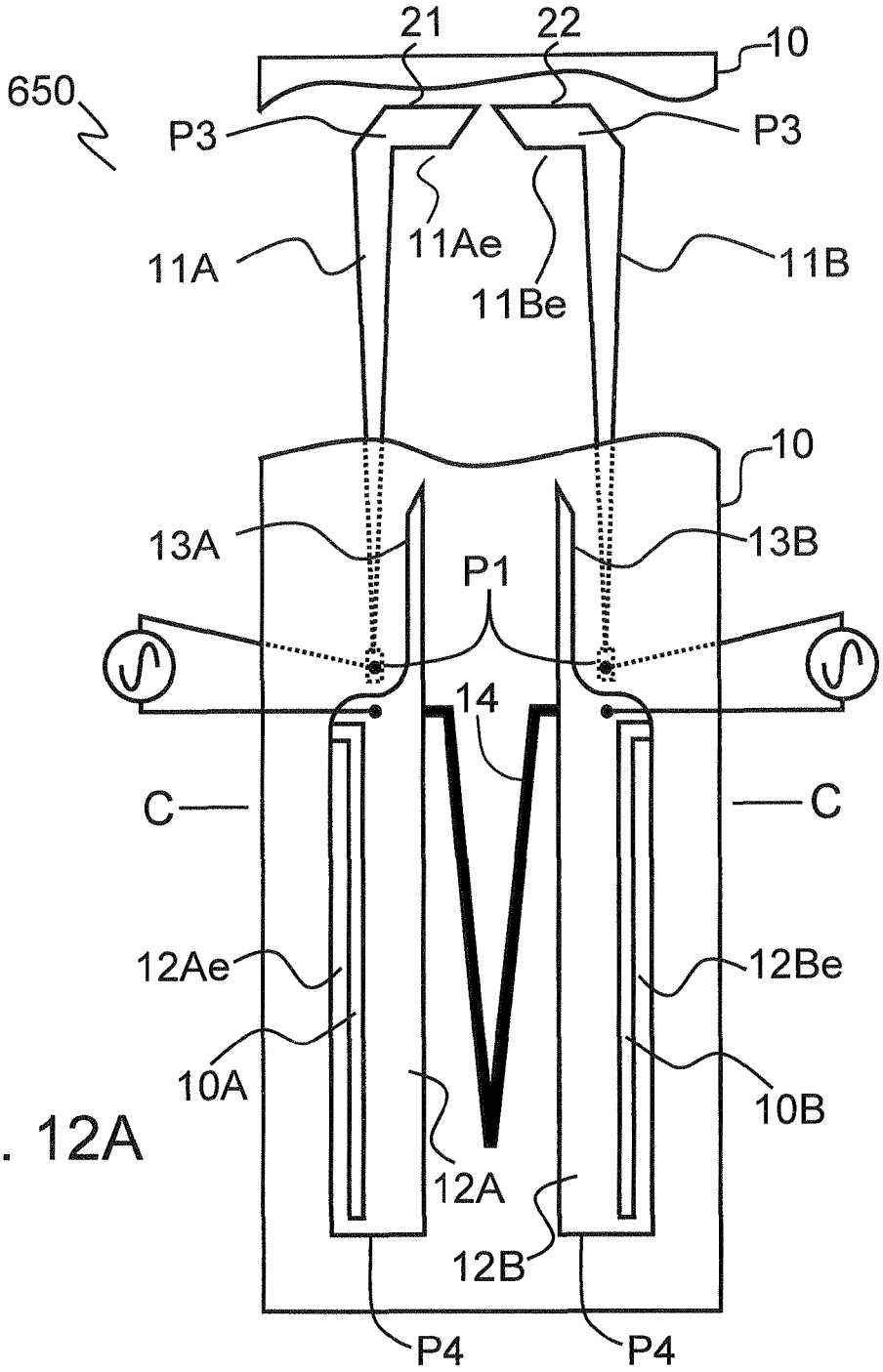
FIGS. 12A and 12B are diagrams illustrating a structure of the antenna according to the third embodiment.
Figure 12B:
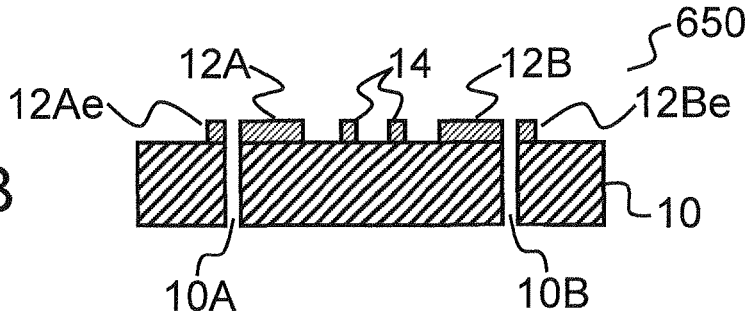

FIGS. 12A and 12B are diagrams illustrating a structure of the antenna 650 as a different example according to the third embodiment. In the present example, the third conductive layer 13A or 13B is provided on one side of the first conductive layer 11A or 11B in each of the antennas, unlike the antenna 640 illustrated in FIGS. 11A and 11B. The configuration of the antenna 650 may also have a similar characteristic to that of the antenna 640 of FIGS. 11A and 11B.

Figure 13A:
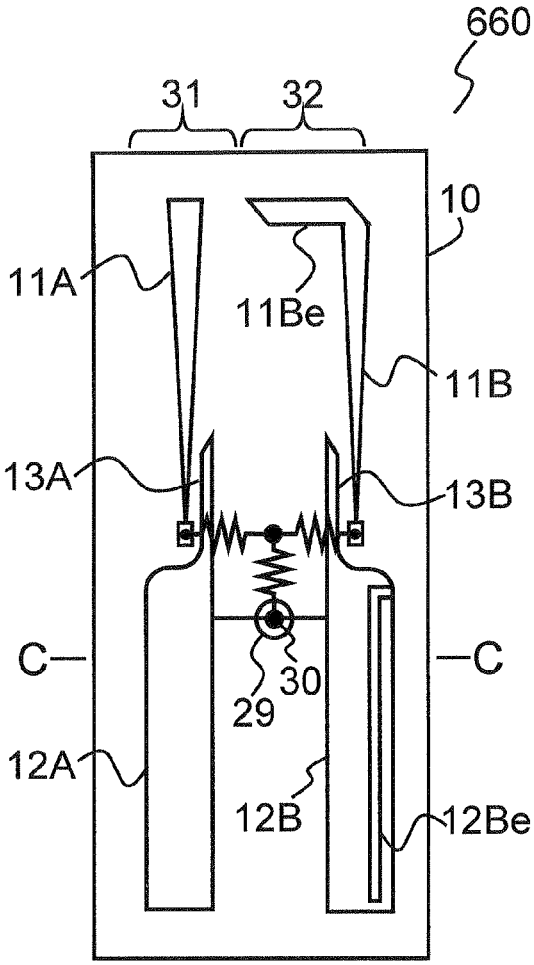
FIGS. 13A to 13D are diagrams illustrating structures of antennas according to a fourth embodiment.
Figure 13B:
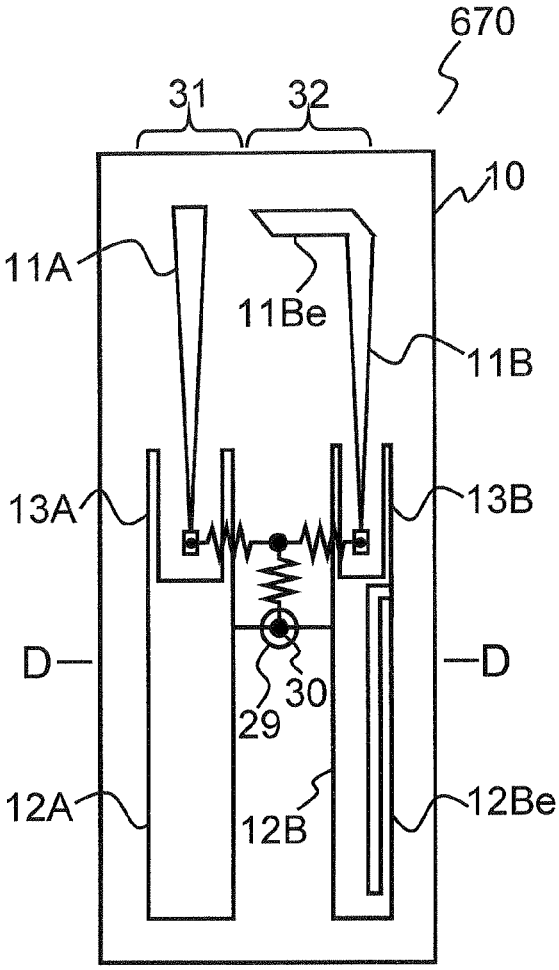
Figure 13C:
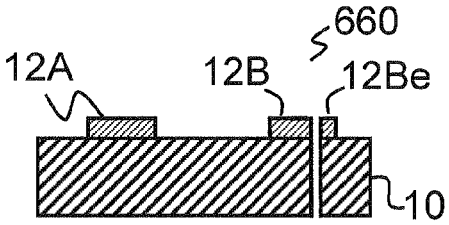
Figure 13D:
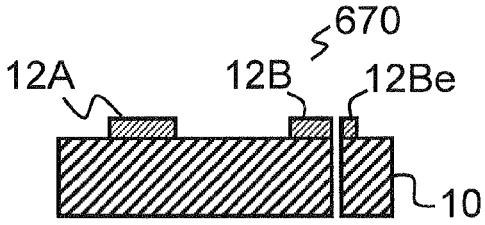

FIGS. 13A and 13C, and 13B and 13C are diagrams illustrating structures of antenna 660 and 670, respectively, according to a fourth embodiment. Each of the antennas 660 and 670 includes two antennas 31 and 32. Each antenna 31 of the antennas 660 and 670 have substantially the similar structure of the antenna 500 and 510 illustrated in FIGS. 1A and 1B, respectively. Each of the antenna 660 and 670 includes the first conductive layer 11A forming a power feeding element and the second conductive layer 12A and the third conductive layer 13A forming a reference potential element. Meanwhile, each antenna 32 of antenna 660 and 670 has substantially the structure similar to each antenna 22 of antennas 650 and 640 illustrated in FIGS. 12A and 11A. As illustrated in FIGS. 13A and 13B, each power feeding element of the antennas 660 and 670 includes the first conductive layer 11B and the fourth conductive layer 11Be, and the reference potential element includes the second conductive layer 12B, the third conductive layer 13B, and the fifth conductive layer 12Be. Further, the same transmitted signal is applied to or induced in the two power feeding elements from an input terminal 30. The reference numeral 29 indicates the ground electrode or the reference potential electrode. In addition, the first conductive layer 11A and the fourth conductive layer 11Be may be preferable to be arranged on the back side of the substrate 10.

The length of the power feeding element formed by the first conductive layer 11B and the fourth conductive layer 11Be of the antenna 32 of the antennas 660 and 670 is longer than the length of the power feeding element formed by the first conductive layer 11A of the each antenna 31. Therefore, the frequency band of each antenna 32 is lower than the frequency band of the antenna 31, and thus the two antennas 31 and 32 have different frequency bands. Further, even if the distance between the antennas 31 and 32 is less than $\lambda/4$, for example, the two antennas have different frequencies and thus are not coupled together. As a result, the paired antennas 31 and 32 have a wide frequency band covering two frequency bands.

The antennas 660 and 670 are preferably arranged so that the power feeding elements and the reference potential elements are separately formed over the opposed surfaces of the dielectric substrate 10 in the same arrangement as the antennas 540, 550 in FIGS. 4A and 4B.

As illustrated in FIG. 13B, the antenna 670 according the fourth embodiment may include a configuration in which the third conductive layer 13A and 13B are provided on both sides of the first conductive layer 11A and 11B, while a configuration in which the third conductive layer 13A and 13B may be provided on one side of the first conductive layer 11A and 11B, respectively as the antenna 660 as illustrated in FIG. 13A.

Figure 14A:
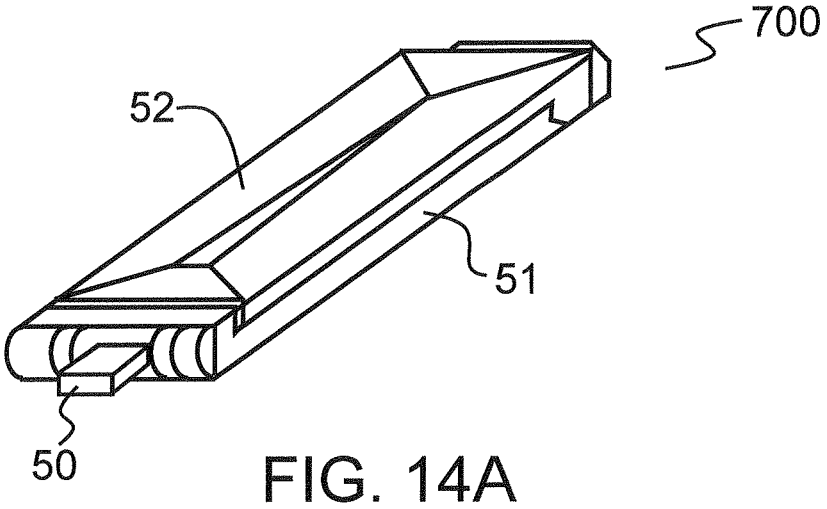
FIGS. 14A and 14B are external views of a communication device including the antenna according to one of the embodiments.
Figure 14B:
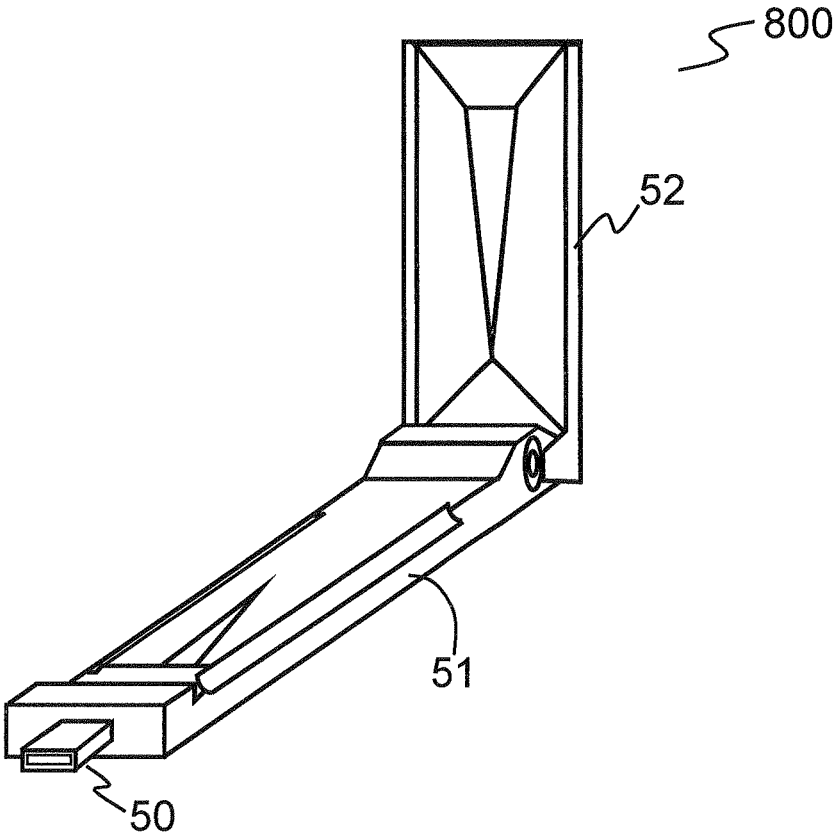

FIGS. 14A and 14B are external views of a communication device including the antenna according to one of the above-described embodiments. FIGS. 14A and 14B illustrate two types of communication devices. Each of the communication devices includes a connector 50, such as a USB (Universal Serial Bus), a first case 51 containing a communication circuit, and a second case 52 storing the antenna. FIG. 14A illustrates a configuration in which the case 52 storing the antenna is laid in the horizontal direction, while FIG. 14B illustrates a configuration in which the case 52 storing the antenna stands upright in the vertical direction. With the configuration of FIG. 14B, radio waves are transmitted in 360° directions around a straight line coupling the power feeding element and the reference potential element of the dipole antenna. Accordingly, it is possible to provide a non-directional antenna except in the upward and downward directions.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. An antenna, comprising:

a dielectric substrate; and an antenna element, comprising:

a first power feeding element including a first conductive layer formed over the dielectric substrate, the first conductive layer extending in a first direction and having a first length along the first direction; and a second power feeding element, comprising:

second conductive layer formed over the dielectric substrate, the second conductive layer extending in a second direction opposed to the first direction from a second position, the second position being apart by a first distance from a first position on an end of the first conductive layer, and a third conductive layer formed over the dielectric substrate, the third conductive element extending from the second position in the first direction apart by a second distance from the first conductive layer and having a third length along the first direction, the second distance being similar to the first distance, wherein a dipole antenna is formed from the first conductive layer and the second conductive layer.

2. The antenna according to claim 1, wherein a transmitting signal is applied to a vicinity of the first position and a reference potential is applied to a vicinity of the second point.

3. The antenna according to claim 2, wherein an impedance between the first position and the second position is 50 ohms.

4. The antenna according to claim 3, wherein the third length is equal to or is smaller than a half of the first length.

5. The antenna according to claim 3, wherein the first length is a quarter of a wavelength of a wave transmitted or received by the power feeding element and the reference potential element, and the third length is within a range of eighth part to twelfth part of the wavelength.

6. The antenna according to claim 2, wherein the third length is equals to or is smaller than a half of the first length.

7. The antenna according to claim 2, wherein the first length is a quarter of a wavelength of a wave transmitted or received by the power feeding element and the reference potential element, and the third length is within a range of eighth part to twelfth part of the wavelength.

8. The antenna according to claim 2, wherein the first conductive layer is formed over a first surface of the dielectric substrate, and the second conductive layer and the third conductive layer are formed over a second surface of the dielectric substrate opposing to the first surface.

9. The antenna according to claim 2, further comprising a set of the antenna element for forming a pair of the antennas which are arranged parallel to each other on the dielectric substrate and a short circuiting conductive layer to coupling between the reference potential elements of the antenna elements, the short circuiting conductive layer being formed over the dielectric substrate and having a fourth length.

10. The antenna according to claim 9, further comprising a first set of switches to change positions at which the short circuiting conductive layers are coupled to each of the reference potential elements.

11. The antenna according to claim 10, further comprising a second set of switches to change the fourth length.

12. The antenna according to claim 9, further comprising a second set of switches to change the fourth length.

13. The antenna according to claim 9, wherein the power feeding element includes a fourth conductive layer extending in a fourth direction from a third position opposite to the first position of the first conductive layer, the fourth direction being different from the first direction, and the reference potential element includes a fifth conductive layer extending in the first direction from a fourth position at an end of the second conductive layer, the end of the second conductive layer being opposite to an end at which the second position is set.

14. The antenna according to claim 9, wherein the power feeding element of a second antenna of the pair of the antennas includes a fourth conductive layer extending in a fourth direction from a third position opposite to the first position of the first conductive layer, the fourth direction being different from the first direction, and the reference potential element of the second antenna includes a fifth conductive layer extending in the first direction from a fourth position at an end of the second conductive layer, the end of the second conductive layer being opposite to an end at which the second position is set.

15. The antenna according to claim 2, wherein the power feeding element includes a fourth conductive layer extending in a fourth direction from a third position opposite to the first position of the first conductive layer, the fourth direction being different from the first direction, and the reference potential element includes a fifth conductive layer extending in the first direction from a fourth position at an end of the second conductive layer, the end of the second conductive layer being opposite to an end at which the second position is set.

16. The antenna according to claim 1, wherein the conductive layer is being single.

17. A communication device, comprising:

an antenna, comprising:

a dielectric substrate; and an antenna element, comprising:

a first power feeding element including a first conductive layer formed over the dielectric substrate, the first conductive layer extending in a first direction and having a first length along the first direction; and a second power feeding, comprising:

a second conductive layer formed over the dielectric substrate, the second conductive layer extending in a second direction opposed to the first direction from a second position, the second point being apart by a first distance from a first position on an end of the first conductive layer, and a third conductive layer formed over the dielectric substrate, the third conductive element extending from the second position in the first direction apart by a second distance from the first conductive layer and having a third length along the first direction, the first distance and the second distance being similar to each other, wherein a dipole antenna is formed from the first conductive layer and the second conductive layer, and a communicating circuit device to supply a transmitting signal to the first power feeding element and a reference potential to the second power feeding element.

18. The communication device according to 17, further comprising a set of the antenna element for forming a pair of the antennas which are arranged parallel to each other on the dielectric substrate and a short circuiting conductive layer to coupling between the reference potential elements of the antenna elements, the short circuiting conductive layer being formed over the dielectric substrate and having a fourth length.

19. An antenna, comprising:

a dielectric substrate; and an antenna element, comprising:

a first power feeding element including a first conductive layer formed over the dielectric substrate, the first conductive layer extending in a first direction and having a first length along the first direction; and a second power feeding element, comprising:

a second conductive layer formed over the dielectric substrate, the second conductive layer extending in a second direction opposed to the first direction from a second position, the second position being apart by a first distance from a first position on an end of the first conductive layer, and a third conductive layer formed over the dielectric substrate, the third conductive element extending from the second position in the first direction apart by a second distance from the first conductive layer and having a third length along the first direction, the third length being smaller than a half of the first length, wherein a dipole antenna is formed from the first conductive layer and the second conductive layer.

20. The antenna according to claim 19, the third conductive layer being single.

* * * * *